US007171797B2

(12) United States Patent
Brehm

(10) Patent No.: US 7,171,797 B2
(45) Date of Patent: Feb. 6, 2007

(54) VERTICAL HEAD

(76) Inventor: Alex Brehm, Rd. #1, Box 516A, East Freedom, PA (US) 16637

( * ) Notice: Subject to any disclaimer, the term of this patent is extended or adjusted under 35 U.S.C. 154(b) by 3 days.

(21) Appl. No.: 10/849,187

(22) Filed: May 20, 2004

(65) Prior Publication Data

US 2005/0284420 A1 Dec. 29, 2005

(51) Int. Cl.
*B68B 1/04* (2006.01)
*B68B 1/00* (2006.01)

(52) U.S. Cl. ..... 54/13; 54/71

(58) Field of Classification Search ..... 54/71, 54/12, 13, 1; 119/850; D30/136, 163
See application file for complete search history.

(56) References Cited

U.S. PATENT DOCUMENTS

| | | | | |
|---|---|---|---|---|
| 237,587 | A * | 2/1881 | Perkins | 54/13 |
| 275,927 | A * | 4/1883 | McCue | 54/13 |
| 832,921 | A * | 10/1906 | McAlpin | 54/13 |
| 6,643,999 | B1 * | 11/2003 | Wheat | 54/71 |

* cited by examiner

*Primary Examiner*—Teri Pham Luu
*Assistant Examiner*—Elizabeth Shaw
(74) *Attorney, Agent, or Firm*—Dwight G. Diehl

(57) ABSTRACT

The present device is utilized by equestrian riders to maintain their horse's forehead vertical with the ground. It is made of plastic and readily attaches to the bridle on top of the horse's head, between the ears. A colored indicator is visible to the rider through an opening in the device and lets the rider know if the animal's head is vertical with the ground or if the nose is back or away from the animal's body. This device will aid the rider and horse to learn how to position and maintain the animals forehead vertical with the ground.

3 Claims, 3 Drawing Sheets

VERTICAL HEAD

BRIEF DESCRIPTION OF INVENTION

The present invention deals with an aid for riders when training their horses or in Equestrian competition. The present device is to aid the rider in keeping the horse's head in the correct position during the show. That position being with the forehead of the animal nearly vertical to the ground and with the present device indicating that position. The present invention will also indicate to the rider whether the horse's head is pitched slightly in or outward from the body of the horse or vertical with the ground. The inventor has been working with and training Equestrian competitors for numerous years and is not aware of any prior device in the art that aids in helping the competitor to monitor the position of the animal's forehead.

DETAILED DESCRIPTION OF THE INVENTION

Figure 1:
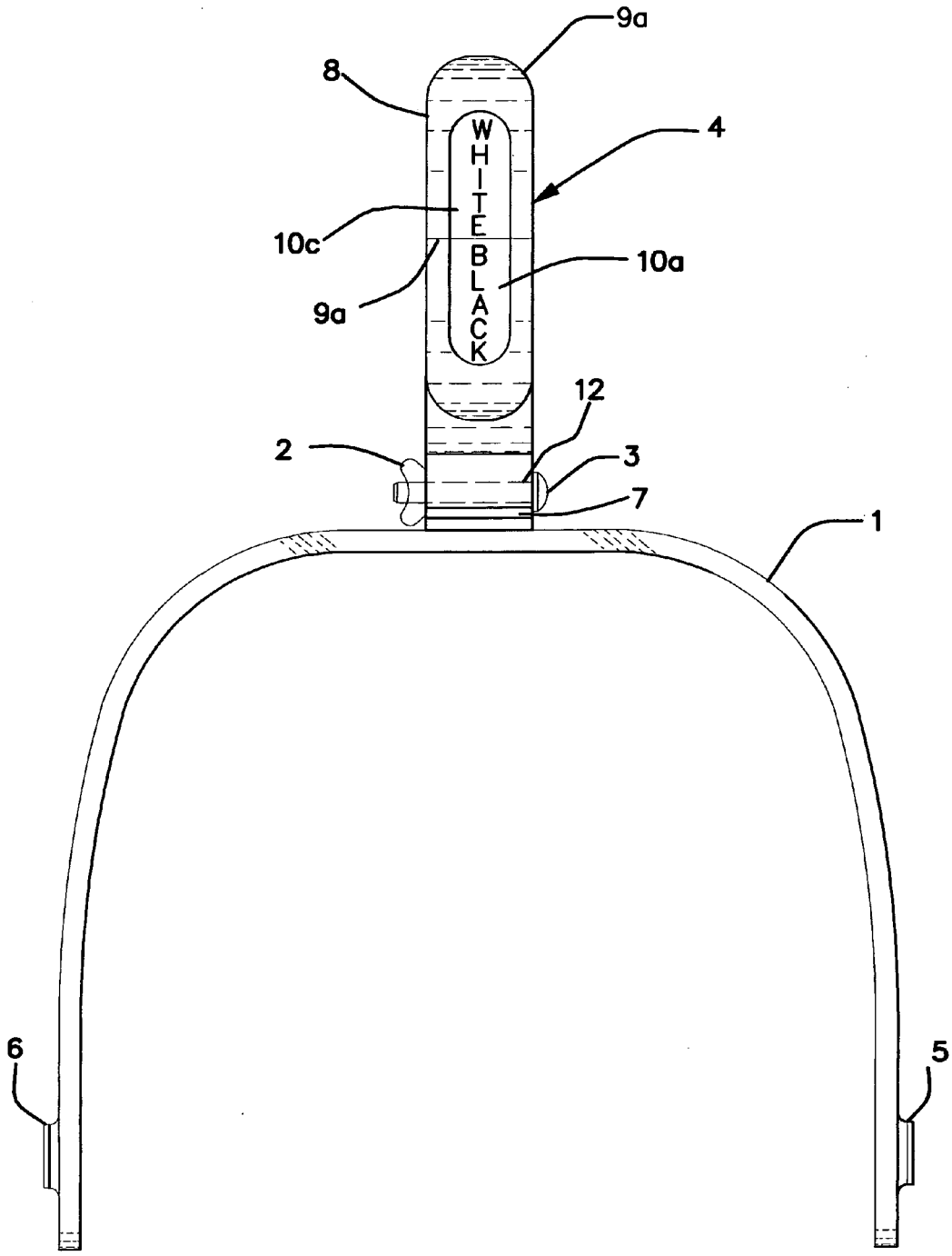
FIG. 1 is a frontal view of the present invention.
Figure 2:
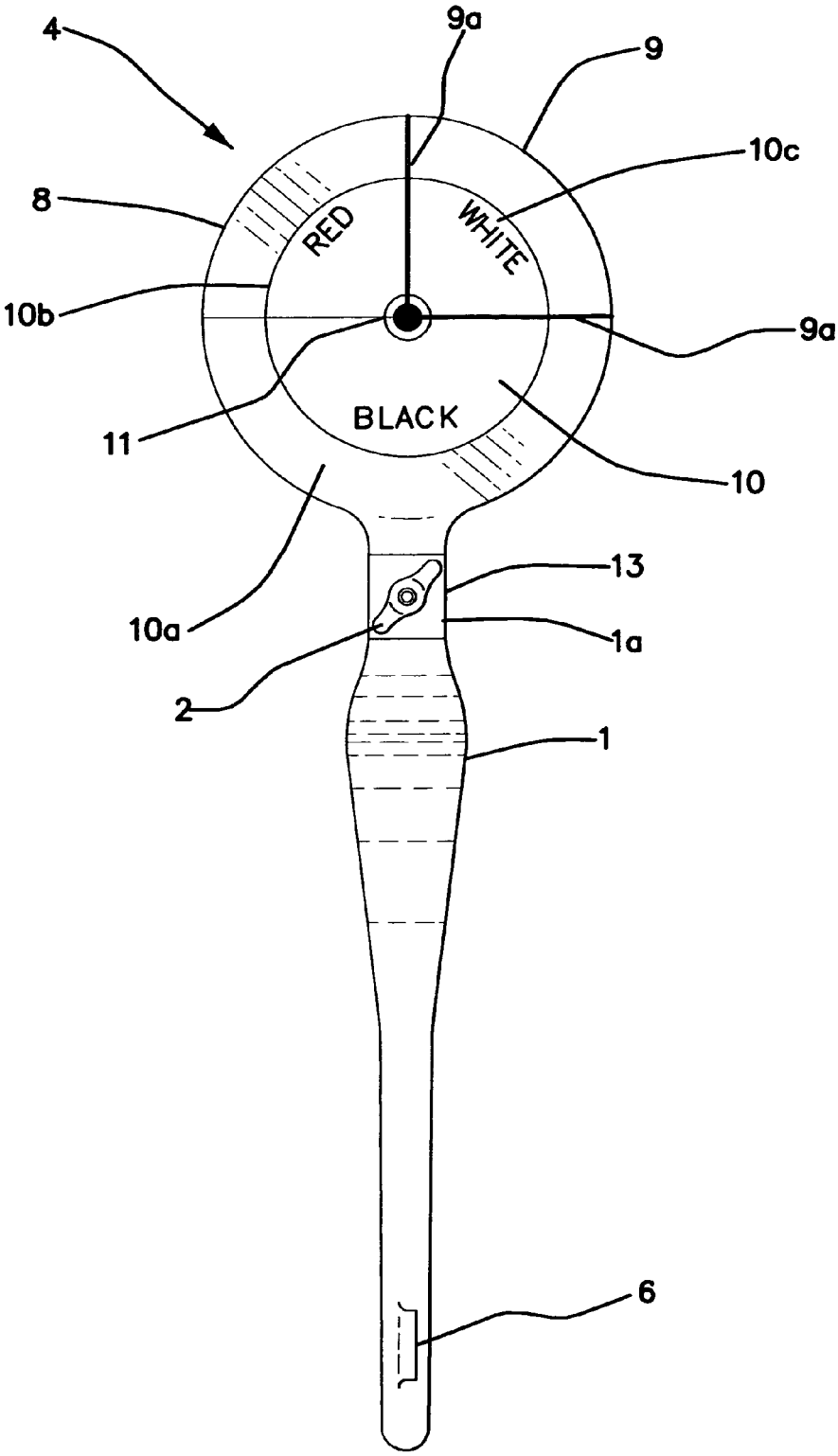
FIG. 2 is a side view of the present invention.
Figure 3:
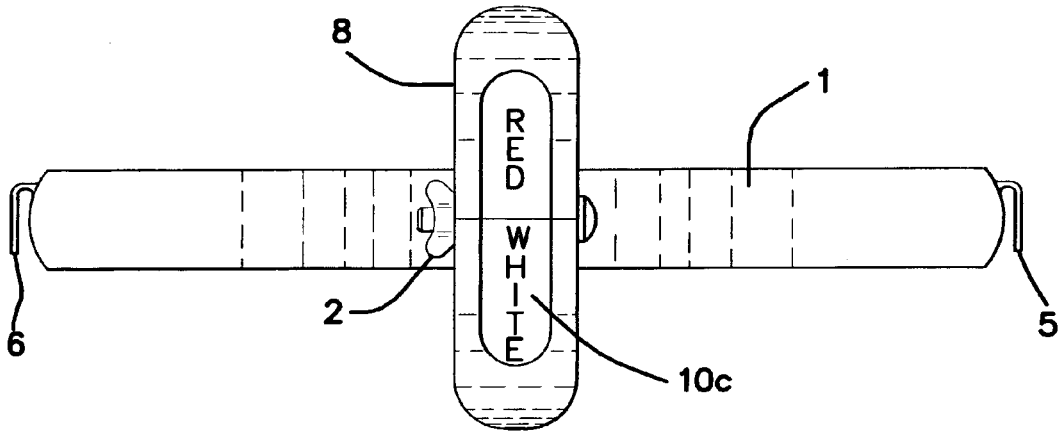
FIG. 3 is a top view of the present invention.
Figure 4:
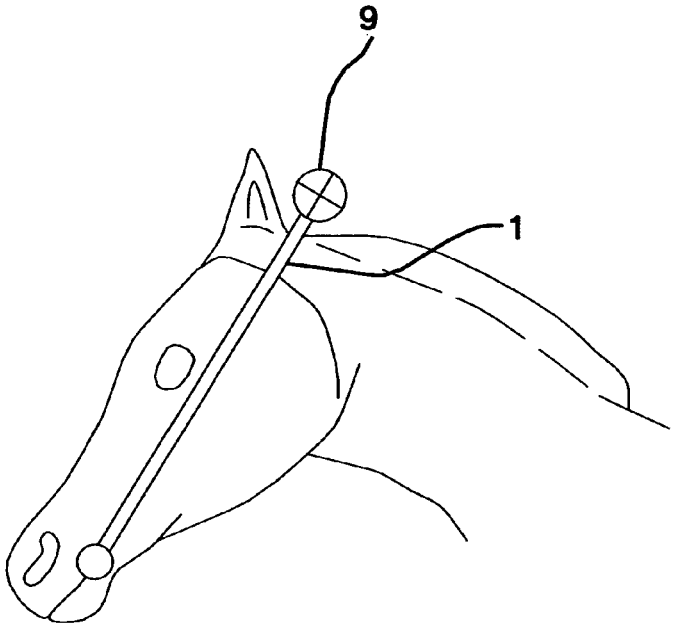
FIG. 4 is a view illustrating the present invention in use.

The present invention consists of a number of pieces interconnected to visually display the position of the horse's head to the rider. The invention is comprised of a horseshoe shaped element 1, a wingnut and bolt 2,3, and a display unit 4. The horseshoe element 1 contains two clips, 5 and 6, thereon and a slot 7 which attach to use bridle 20 of the horse in competition. These clips 5 and 6 as shown in the preferred embodiment face in the same direction to be attached to the bridal. However, it would be obvious to one of ordinary skill in the art that they could face in opposing directions to be clipped onto the bridle. The slot 7 is formed in the horseshoe element 1, in a connecting piece 1*a* extending above the horseshoe and containing the slot 7 and a hole 12. The bolt 2 and the wingnut 3, attach the display unit 4 to the horseshoe element 1, the bolt traverses through the hole 12 in element 1 and a slot 13 in display unit 4.

The display element 4 is comprised of a clear circular element 8, which contains a window or opening 9 and an indicator 10. The indicator 10 is attached inside of the unit 4 by a pin 11 and the indicator 10 rotates freely thereon. The window 9 is marked on the element 8 by a black line 9*a* surrounding the window 9.

In the preferred embodiment, the indicator element 10 is a colored element comprising the colors red, white, and black. The black portion 10*a* covering one-half of the indicator element 10 and that being the lower one-half of the indicator element. The red and white colors cover the top one-half of the indicator element and each covers one quarter of the top half of the indicator element respectively 10*b*, 10*c*. The window 9 in the display unit 4 is a window of one-quarter the circumference of the outer diameter of the display unit 4. Through the window the three colors are visible to the rider while aboard a horse. The clips 5 and 6, and the slot 7 attach to the bridle 20 with the indicator unit 4 located behind the ears of the horse atop of the neck with the window 9 of the display unit 4 facing the rear of the animal or toward the rider.

As the rider positions the head of the horse, the white color 10*c* of the indicator 10 will fill the window when the horse's head is in a position such that the forehead is vertical to the ground. As the horse's head tilts from the vertical with the nose extending away from the body, the indicator 10 will rotate on the pin 11 and the rider will begin to see part of the black 10*a* on the indicator element enter into the window. Likewise, if the rider restrains the horse's head movement by reigning it in and causing the nose of the horse to approach the body of the animal away from the vertical, the rider will begin to observe the red colored 10*b* portion of the indicator 10 entering the window 9. Thus, by viewing the window 9 on the display unit 4 the rider can accurately control the head position of the animal during competition.

Each animal and/or bridle may have a different body pitch and/or construction and thus the display element 4 would need to be positioned differently relative to the horseshoe element 1 when utilizing the device on different animals. In order to provide for such adjustment, the display unit 4 would have a slot 13 contained therein through which the bolt 2 passes when attaching the display unit 4 to the horseshoe element 1. Thus, once the invention is attached to the bridle 20, one would merely need to place the horse's forehead vertical relative to the ground, adjust the display unit such that the white portion 10*c* of the indicator element 10 completely fills the window 9, and then tighten the wingnut 3 to hold the display unit 4 in this position relative to the horseshoe element 1, thus upon mounting the animal the competitor will be able to visually monitor the position of the animals forehead relative to the vertical by merely glancing at the top of the animals head or neck in the vicinity of its ears and watch the white portion 10*c* of the indicator element 10.

The above description is meant for illustrative purposes only and it is deemed that it would be obvious for one of ordinary skill in the art that any three colors could be used on the indicator wheel and that red, white, and black are merely the preferred colors of the present invention. Further, it is contemplated that the material utilized to make the present invention is a plastic or composite material and thus lightweight and inexpensive to manufacture. However, it is not the material of which the present invention is made that constitutes the novelty of this invention and one of ordinary skill in the art could readily manufacture the present invention out of a multitude of different materials or composites. A further alternative could be to have the element 8 opaque with the indicator 10 only being visible through the window 9.

I claim:

1. A means for visually displaying the position of an animal's forehead relative to a vertical line extending from the ground; said means comprising:

a horseshoe shaped element having two vertical clips located on opposite sides of the horseshoe element;

a connecting means having a slot therein;

and a display unit comprising a window and a circular indicator element having multiple colors thereon, visible through said window;

said connecting means interconnecting the display unit and the horseshoe element.

2. A means as recited in claim 1 above further comprising: the connection means being a bolt and a wingnut.

3. A means as recited in claim 1 above further comprising: the horseshoe element having three slotted elements;

the display means connected to the horseshoe element by the connecting means comprised of a bolt and wingnut; and the display unit having contained therein an indicator element mounted on a pin; and said indicator element rotatable on said pin and visible through said window of said display means.

* * * * *